US011162654B2

(12) United States Patent
Walsh et al.

(10) Patent No.: US 11,162,654 B2
(45) Date of Patent: Nov. 2, 2021

(54) LIGHTING UNITS

(71) Applicants: Terry Patrick Walsh, Stoke-on-Trent (GB); Anthony James Sheldon, Stoke-on-Trent (GB)

(72) Inventors: Terry Patrick Walsh, Stoke-on-Trent (GB); Anthony James Sheldon, Stoke-on-Trent (GB)

( * ) Notice: Subject to any disclaimer, the term of this patent is extended or adjusted under 35 U.S.C. 154(b) by 0 days.

(21) Appl. No.: 16/764,117

(22) PCT Filed: Nov. 14, 2018

(86) PCT No.: PCT/GB2018/053296

§ 371 (c)(1),
(2) Date: May 14, 2020

(87) PCT Pub. No.: WO2019/097224

PCT Pub. Date: May 23, 2019

(65) Prior Publication Data

US 2020/0393095 A1 Dec. 17, 2020

(30) Foreign Application Priority Data

Nov. 14, 2017 (GB) ..... 1718773

(51) Int. Cl.

| | |
|---|---|
| ***F21S 4/26*** | (2016.01) |
| ***F21S 2/00*** | (2016.01) |
| ***F21V 23/00*** | (2015.01) |
| ***F21S 4/20*** | (2016.01) |
| ***F21Y 103/10*** | (2016.01) |

(Continued)

(52) U.S. Cl.
CPC ..... *F21S 4/26* (2016.01); *F21S 2/005* (2013.01); *F21S 4/20* (2016.01); *F21V 23/002* (2013.01); *F21V 33/006* (2013.01); *F21Y 2103/10* (2016.08); *F21Y 2115/10* (2016.08)

(58) Field of Classification Search
CPC ..... F21S 4/26; F21S 4/24; F21S 4/22; F21S 4/20; F21S 2/005; F21V 23/002
See application file for complete search history.

(56) References Cited

U.S. PATENT DOCUMENTS 5,559,681 A 9/1996 Duarte
6,354,714 B1 * 3/2002 Rhodes ..... F21S 4/24 362/153.1

(Continued)

FOREIGN PATENT DOCUMENTS

DE 202010017009 U1 2/2011
DE 102016104649 A1 6/2017

(Continued)

OTHER PUBLICATIONS

Machine translation of "Bielert et al.", DE 102016104649A1, published Jun. 14, 2017 (Year: 2017).*

(Continued)

*Primary Examiner* — William N Harris
(74) *Attorney, Agent, or Firm* — Lee & Hayes, P.C.

(57) ABSTRACT

A lighting unit 18 usable in a conventional electrical conduit system. The unit 18 comprising a plastics material body 20 extendible between two houses 14. The body 20 has a rectangular channel 22 which mounts an elongate lighting member 26 comprising a plurality of interconnecting LEDs 28 mounted on a tape 29.

15 Claims, 6 Drawing Sheets

(51) Int. Cl.
*F21Y 115/10* (2016.01)
*F21V 33/00* (2006.01)

(56) References Cited

U.S. PATENT DOCUMENTS

| | | | | |
|---|---|---|---|---|
| 6,361,186 | B1 * | 3/2002 | Slayden | F21V 3/02 362/241 |
| 7,213,941 | B2 * | 5/2007 | Sloan | F21V 21/005 362/20 |
| 8,899,778 | B2 * | 12/2014 | Yang | F21V 29/505 362/217.09 |
| 8,985,795 | B2 * | 3/2015 | Thomas | A47F 3/001 362/92 |
| 9,163,794 | B2 * | 10/2015 | Simon | F21K 9/275 |
| 9,726,336 | B2 * | 8/2017 | Rao | F21K 9/27 |
| 2003/0174517 | A1 * | 9/2003 | Kiraly | G01N 21/8806 362/555 |
| 2005/0265019 | A1 * | 12/2005 | Sommers | F21S 4/20 362/217.16 |
| 2005/0286260 | A1 * | 12/2005 | Liu | F21S 4/26 362/551 |
| 2008/0239716 | A1 | 10/2008 | Lin | |
| 2008/0314944 | A1 * | 12/2008 | Tsai | F21V 21/088 224/331 |
| 2010/0061095 | A1 * | 3/2010 | Hoffmann | F21S 8/022 362/235 |
| 2010/0135020 | A1 * | 6/2010 | Moore | A47F 11/10 362/249.02 |
| 2012/0092875 | A1 * | 4/2012 | Cho | F21S 2/005 362/311.01 |
| 2012/0201024 | A1 * | 8/2012 | van de Ven | F21S 4/26 362/231 |
| 2013/0242570 | A1 * | 9/2013 | Chen | F21V 15/01 362/362 |
| 2013/0258668 | A1 | 10/2013 | Delllian | |
| 2015/0049473 | A1 | 2/2015 | Pan | |
| 2015/0062890 | A1 | 3/2015 | Camarota | |
| 2015/0330584 | A1 * | 11/2015 | Bobbo | F21K 9/20 362/220 |
| 2016/0146445 | A1 | 5/2016 | Shine | |
| 2017/0254526 | A1 * | 9/2017 | Hall | F21V 3/00 |

FOREIGN PATENT DOCUMENTS

| | | | |
|---|---|---|---|
| DE | 202016101515 | U1 | 6/2017 |
| KR | 101781832 | B1 | 9/2017 |
| WO | 2012/124440 | A1 | 9/2012 |
| WO | 2015/110306 | A1 | 7/2015 |

OTHER PUBLICATIONS

GB Combined Search and Examination Report dated Jun. 28, 2018, for GB Appl. No. 1718773.3, 3 pages.

GB Examination Report dated Jul. 12, 2019 for GB Appl. No. 1718773.3, 3 pages.

PCT International Search Report and Written Opinion for PCT Appl. No. PCT/GB2018/053296, dated Jan. 18, 2019, 10 pages.

* cited by examiner

LIGHTING UNITS

CROSS REFERENCE TO RELATED APPLICATIONS

This application is a U.S. national stage entry of International Patent Application No. PCT/GB2018/053296, filed Nov. 14, 2018, entitled "LIGHTING UNITS," which claims priority to GB Application No. 1718773.3, filed Nov. 14, 2017, entitled "LIGHTING UNITS," the entire contents of each of which are incorporated by reference herein.

BACKGROUND

This invention concerns lighting units.

Electrical conduit systems have been widely used for a number of years. Such systems often comprise a plurality of tubular conduits through which wiring extends. The conduits may be of standard lengths and often extend between junction boxes which may for instance be circular in plan view.

Conduit systems can be used internally or externally and are widely used on external buildings or structures such as car parks, stairways, subways etc. Conventionally conduit systems connect to standard lighting units such as luminaires.

SUMMARY

According to an aspect of the invention there is provided a lighting unit, the lighting unit having an elongate body with an at least substantially cylindrical configuration, the body being configured to fit within an electrical conduit system such that in use electrical wiring can pass through the conduit system via the body, the lighting unit including an elongate lighting member extending along at least part of the body so that light therefrom when illuminated is visible, wherein the body is rotatably connectable to other components in the electrical conduit system.

The body may include an elongate recess to locate the elongate lighting member. The body may include an elongate passage located behind the elongate recess.

The body may include a plurality of elongate recesses to each locate a respective lighting member.

The elongate recess may include a channel to locate the elongate lighting member, with an elongate opening to the channel of reduced width relative to the channel, for light to pass through. Part or all of the body may be of constant cross section.

A diffuser or cover may be provided mountable on the body such that light from the or each lighting member can shine therethrough.

The lighting member may include a plurality of LEDs, which LEDs may be colour change LEDs.

The LEDs may be provided in the lighting member along the length of a flexible elongate carrier, which carrier may be made of silicone. The carrier may carry electrical connections to the LED.

The body may be made of plastics material, or may be made of metal such as steel or aluminium.

According to a further aspect of the invention an electrical conduit system is provided including a plurality of connectable components, including one or more lighting units according to any of the preceding nine paragraphs.

BRIEF DESCRIPTION OF THE DRAWINGS

Embodiments of the present invention will now be described by way of example only with reference to the accompanying drawings, in which.

DETAILED DESCRIPTION

Figure 1:
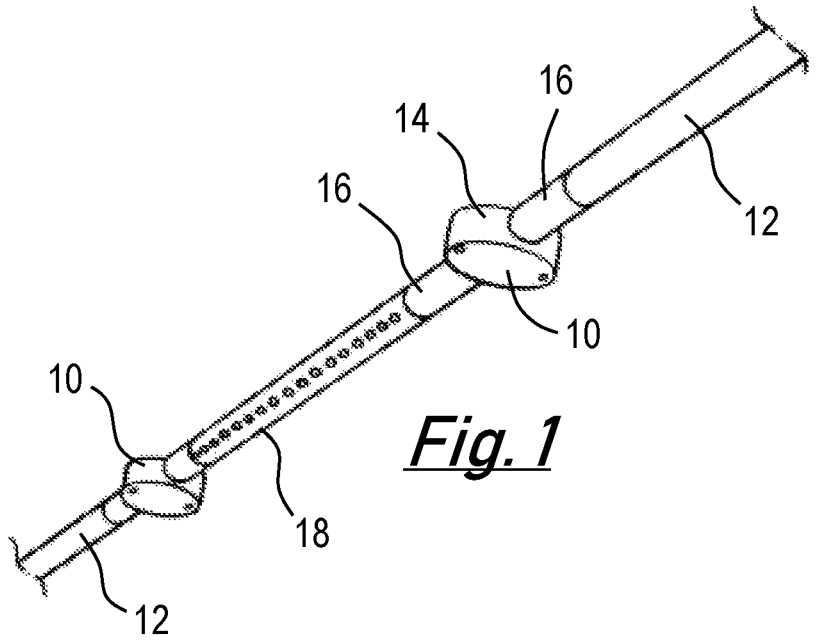
FIG. 1 is a diagrammatic perspective view of a first lighting unit according to the invention installed within an electrical conduit system.

FIG. 1 shows a conventional electrical conduit system including junction boxes 10 interconnected by lengths of conduit 12. Each junction box 10 comprises a housing 14 which is circular in plan view, and includes diametrically opposite cylindrical mounting sleeves 16 extending from each side. As is conventional standard lengths of cylindrical tube 12 fit between the junction boxes 10, and rotatingly locate in the mounting sleeves 16.

In this instance a lighting unit 18 according to the invention extends between the mounting sleeves 16 on two junction boxes 10 in a similar manner to the standard cylindrical tubes 12. The lighting unit 18 comprises a plastics material extruded body 20 which is overall circular in cross section, with a rectangular channel 22 formed against one side defining a recess, with an elongate opening 24 being provided along the outer side of the channel 22.

The opening 24 being of reduced width relative to the remainder of the channel 22.

Figure 2:
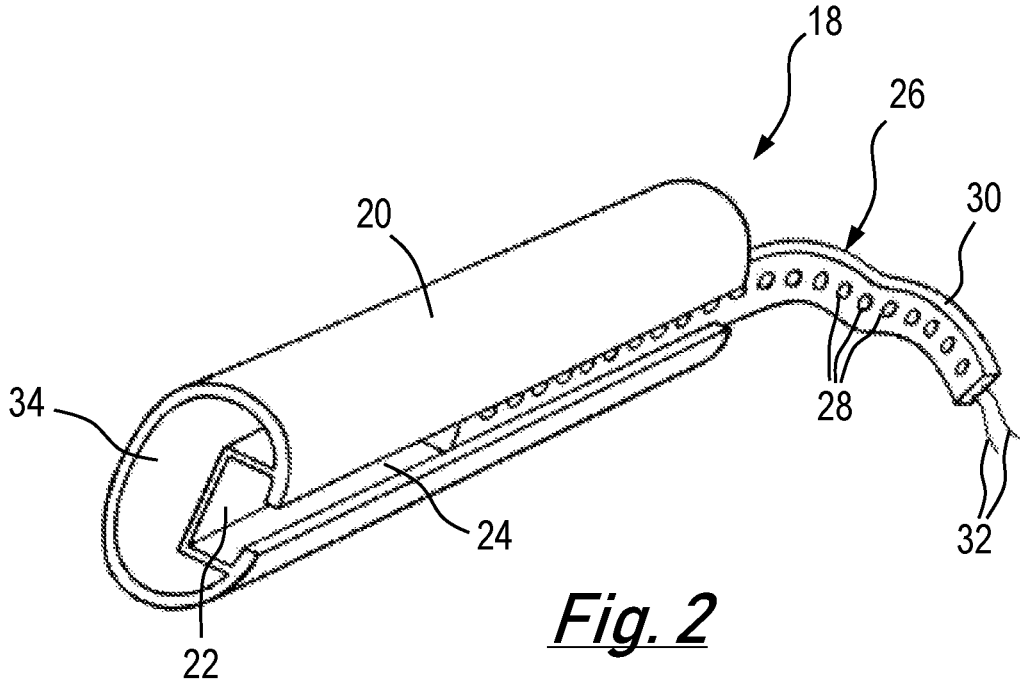
FIG. 2 is a diagrammatic partially assembled perspective view of the lighting unit of FIG. 1 during assembly.
Figure 3:
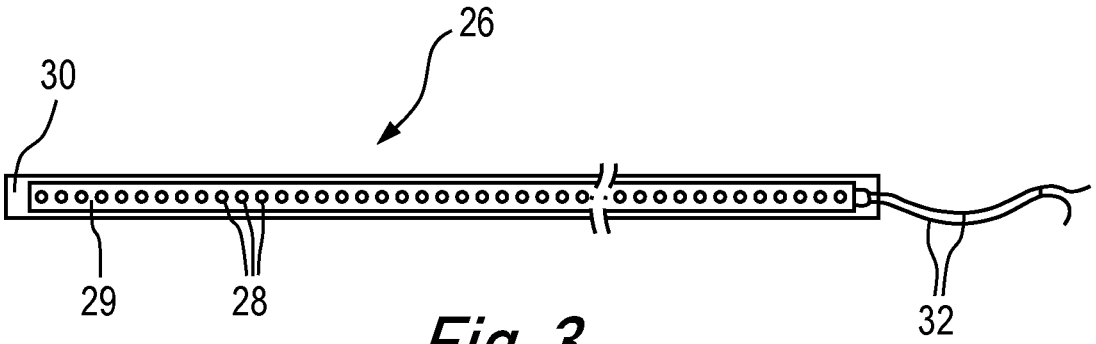
FIG. 3 is a diagrammatic plan view of part of the lighting unit of FIG. 1.
Figure 4:
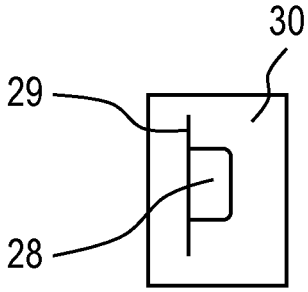
FIG. 4 is an end view of the part shown in FIG. 3.
Figure 5:
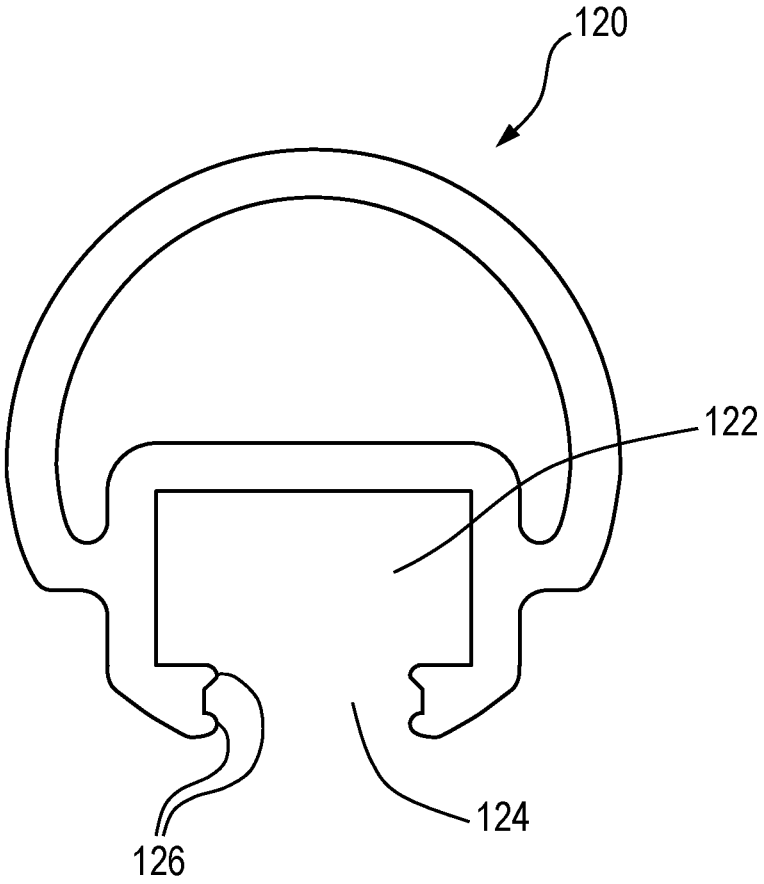
FIGS. 5-8 are respectively end views of parts of second, third, fourth and fifth lighting units according to the invention.
Figure 6:
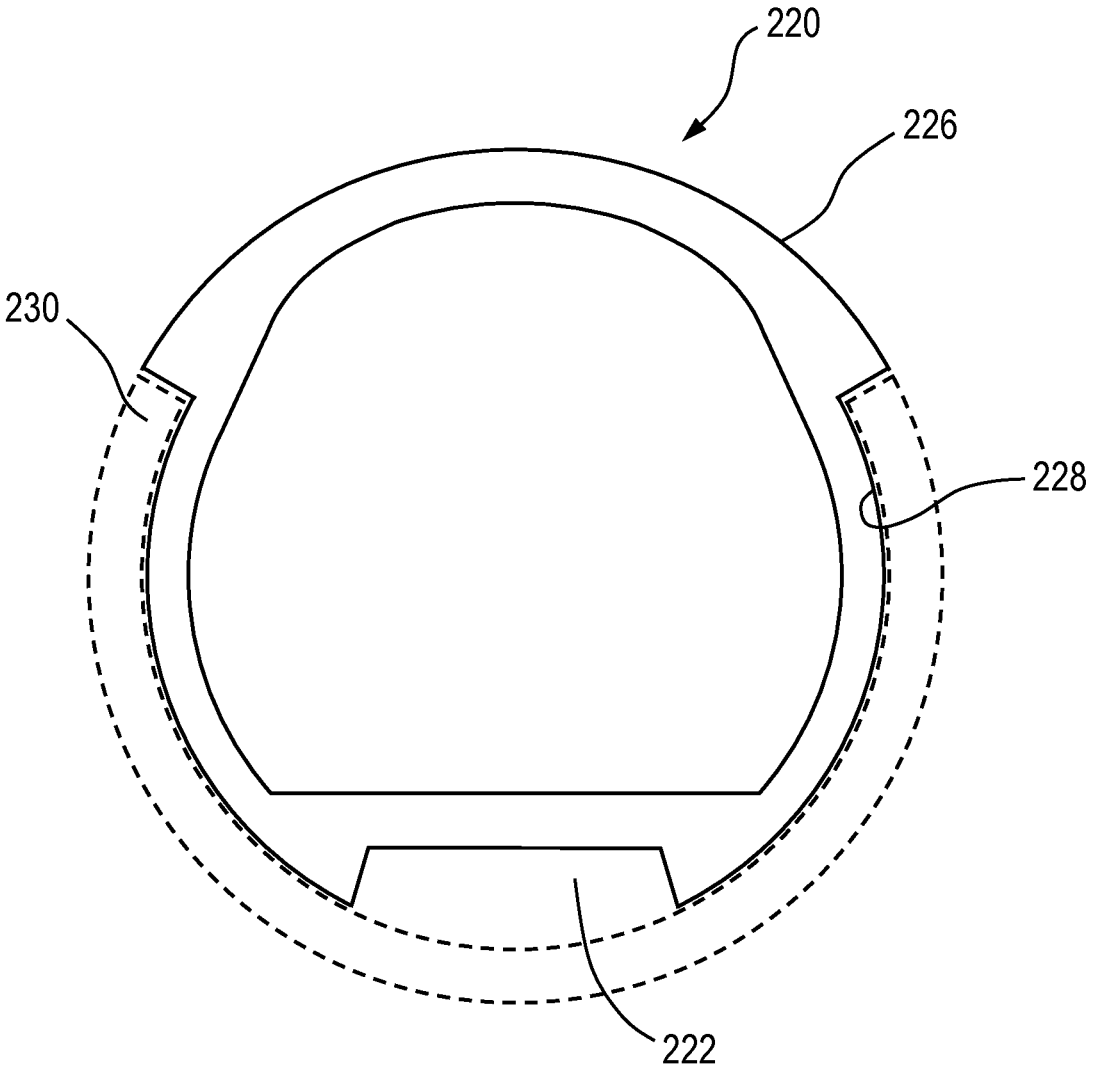

An elongate lighting member 26 locates in the recess defined by the channel 22. The elongate lighting member 26 comprises a plurality of interconnected LEDs 28 which may be mounted on a tape 29, located within a silicone body 30, with electrical connections leading 32 from the lighting member 26. As can be seen in FIG. 2, the elongate lighting member 26 is a sliding fit within the channel 22.

The lighting unit 18 can therefore be fitted in an electrical conduit system in a conventional manner as per the standard cylindrical tubes 12. When the lighting member 26 is powered, light will pass out through the opening 24. The body 20 can be rotated relative to the junction boxes 10 such that light shines in a required direction, such as upwardly, downwardly or outwardly as desired. Any other electrical cabelling can extend through the body 20 in the space 34 behind the channel 22. The LEDs 28 may be colour change LEDs such that a required colour can be shone. The colours could be changed to provide particular signals or an indication of different conditions.

FIGS. 5-8 show respectively bodies 120, 220, 320 and 420 of second to fifth lighting units according to the invention. The body 120 of the second lighting unit is similar to the body 20, though the moulding is more rounded. Also inner and outer lips 126 are provided on sides of the opening 124 to permit a diffuser or cover (not shown) to be mounted if required to protect a lighting member (not shown) located in the channel 122. Obviously a diffuser would also diffuse light from the lighting unit.

The body 220 of the third lighting unit has a first outer portion 226 extending for approximately a third of the circumference of the body 220 and a second portion 228 extending for the other two thirds of the circumference of the body. The second portion 228 being of slightly smaller diameter such that a diffuser 230 can locate on the second portion 228, with the diameter of the second portion plus the diffuser 230 being similar to the diameter of the first portion 226.

A single channel 222 is provided diametrically opposite the first portion 226. The channel 222 diverge radially outwardly. Obviously the diffuser 230 will also act as a cover to protect any lighting members located in the channel 222.

Figure 7:
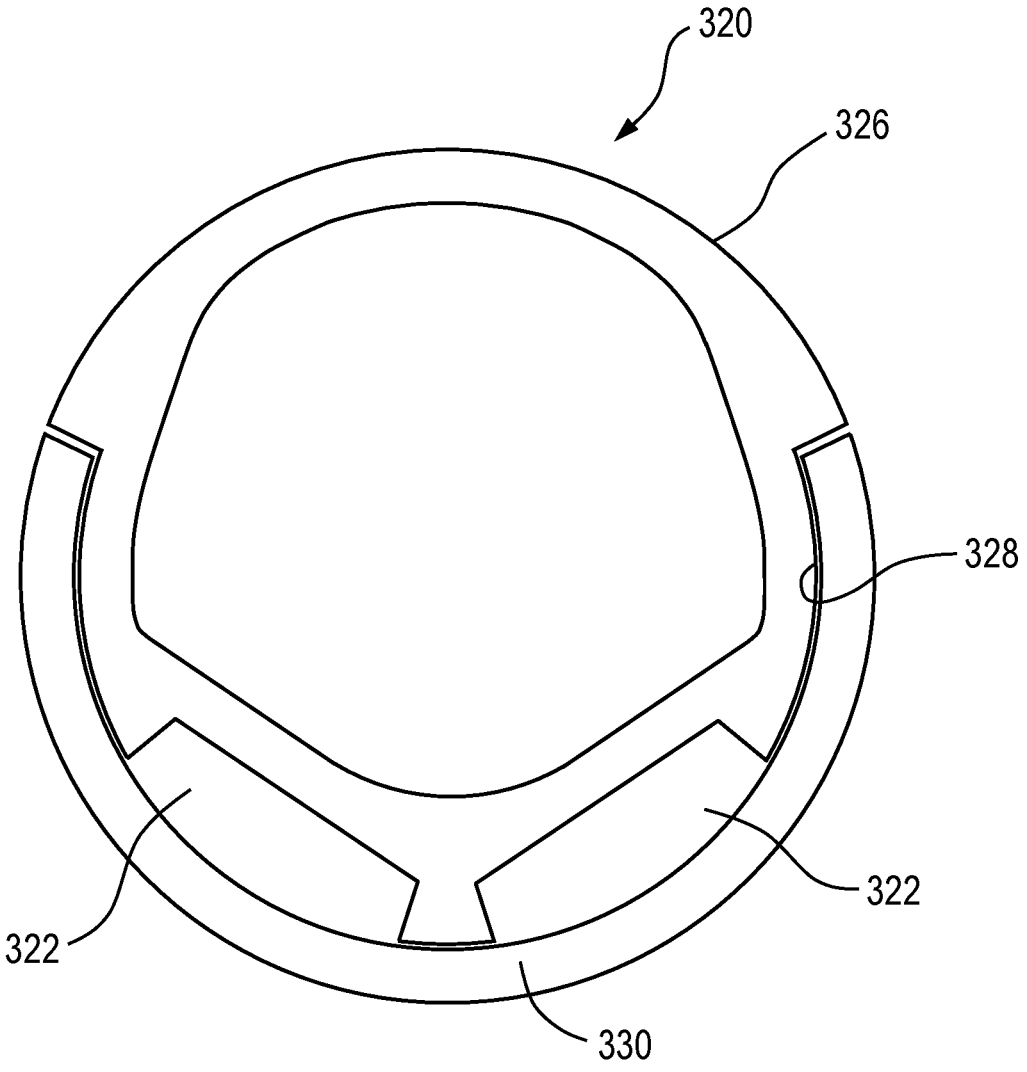

FIG. 7 shows a body 320 which is similar to the body 220 except two channels 322 are provided adjacent each other, and again diametrically opposite a first portion 326 of greater diameter relative to a second portion 328, which second portion 328 mounts the diffuser 330. This enables two lighting members to be mounted adjacent each other to provide a greater amount of light.

Figure 8:
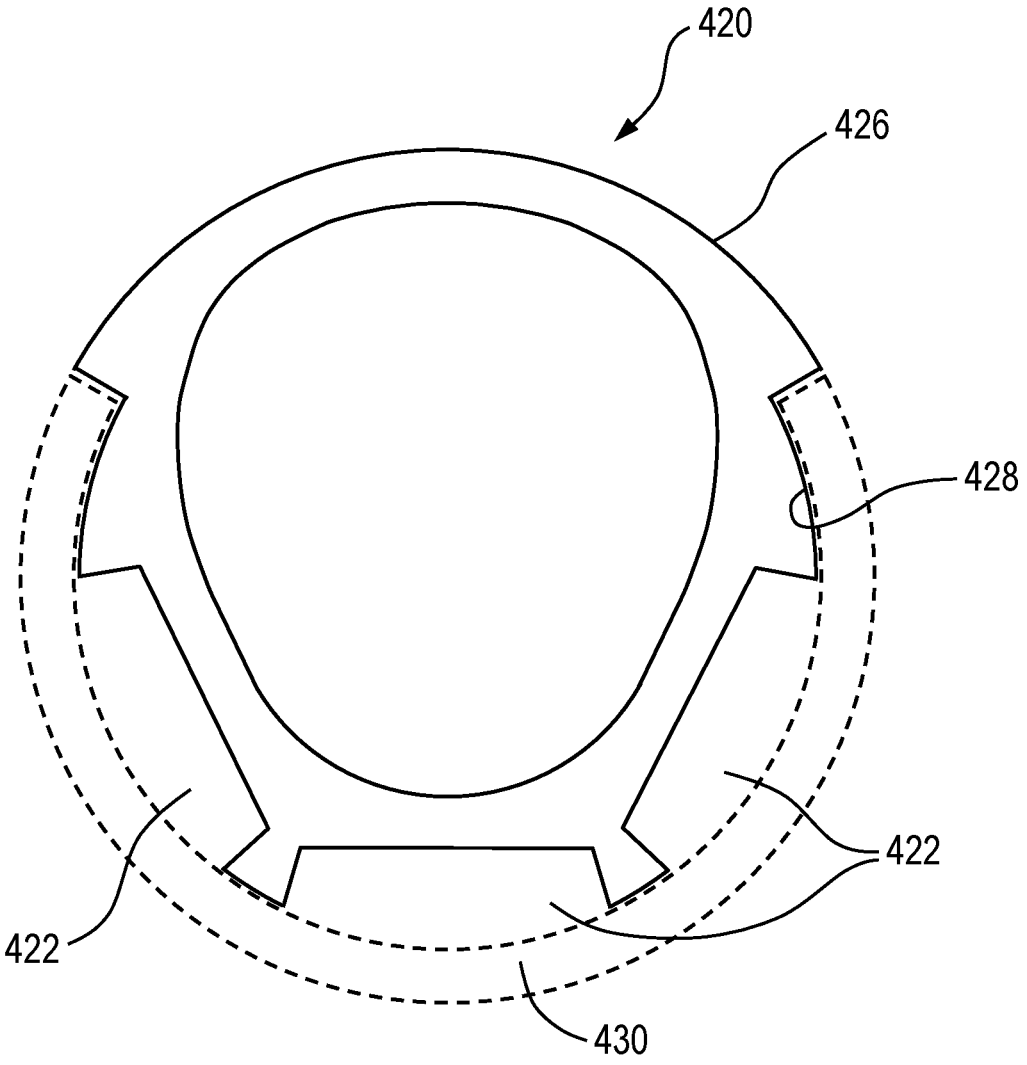

FIG. 8 shows the third body 420 which is similar to the bodies 220 and 320 but provides three channels 422 again adjacent each other and diametrically opposite a first portion 426 of greater diameter with a similar portion 428 of lesser diameter mounting a diffuser 430. The body 420 permits three lighting members to be mounted adjacent each other to provide further increased lighting.

In practice the electrical conduit system could be installed as is conventional, for instance in a car park, subway or other location. The lighting units can be lit and therefore remove the requirement for separate luminaires or other lighting arrangements. The lighting units therefore provide a very neat and aesthetically appealing lighting arrangement, but which is very flexible and can be adapted as dictated by different conditions or locations. The lighting units can be arranged to provide different colours, so as to be decorative, or perhaps to illustrate different conditions such as something being closed, or to direct persons to a particular location.

There are thus described lighting units and a system using such lighting units which provide for a number of advantages. The lighting units can be mounted in the same way as other parts of the conduit system whilst providing an aesthetically pleasing lighting arrangement. The lighting units can readily be replaced or removed for repair or otherwise as required.

Various other modifications may be made without departing from the scope of the arrangement. A different lighting member may be used and this could be mounted differently in the body. The body and/or junction boxes may take a different form.

The invention claimed is:

1. A lighting unit, the lighting unit having an elongate body with an at least substantially cylindrical configuration, the elongate body including an elongate recess formed against an outer surface of the elongate body and an elongate passage located behind the elongate recess, the elongate body being configured to fit within an electrical conduit system such that in use electrical cabling can pass through the electrical conduit system via the elongate passage, the lighting unit including an elongate lighting member located in the elongate recess and extending along at least part of the elongate recess so that light therefrom when illuminated is visible, wherein the elongate body is rotatably connectable to other components in the electrical conduit system.

2. A lighting unit according to claim 1, in which the elongate body includes a plurality of elongate recesses to each locate a respective lighting member.

3. A lighting unit according to claim 1, in which the elongate recess includes a channel to locate the elongate lighting member, with an elongate opening to the channel of reduced width relative to the channel, for light to pass through.

4. A lighting unit according to claim 1, in which part or all of the elongate body is of constant cross section.

5. A lighting unit according to claim 1, in which a diffuser or cover is provided mountable on the elongate body such that light from the elongate lighting member can shine therethrough.

6. A lighting unit according to claim 1, in which the elongate lighting member includes a plurality of LEDs.

7. A lighting unit according to claim 6, in which the LEDs are colour change LEDs.

8. A lighting unit according to claim 6, in which the LEDs are provided in the elongate lighting member along the length of a flexible elongate carrier.

9. A lighting unit according to claim 8, in which the flexible elongate carrier is made of silicone.

10. A lighting unit according to claim 8, in which the flexible elongate carrier carries electrical connections to the LEDs.

11. A lighting unit according to claim 1, in which the elongate body is made of any of plastics material, metal, steel or aluminium.

12. An electrical conduit system including a plurality of connectable components, including one or more lighting units according to claim 1.

13. A lighting unit according to claim 1, in which a cross-sectional area defined by the elongate passage is greater than a cross-sectional area defined by the elongate recess.

14. A lighting unit according to claim 1, in which the elongate recess includes a channel to locate the elongate lighting member, and the elongate lighting member is slidingly fit within the channel.

15. A lighting unit according to claim 1, in which the elongate lighting member is located entirely within the elongate recess.

* * * * *